US008365842B2

(12) United States Patent
Hall et al.

(10) Patent No.: US 8,365,842 B2
(45) Date of Patent: Feb. 5, 2013

(54) RATCHET MECHANISM IN A FLUID ACTUATED DEVICE

(75) Inventors: David R. Hall, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 454 days.

(21) Appl. No.: 12/608,744

(22) Filed: Oct. 29, 2009

(65) Prior Publication Data

US 2010/0212884 A1 Aug. 26, 2010

Related U.S. Application Data

(63) Continuation-in-part of application No. 12/511,209, filed on Jul. 29, 2009, which is a continuation of application No. 12/511,185, filed on Jul. 29, 2009, which is a continuation-in-part of application No. 12/424,853, filed on Apr. 16, 2009, now Pat. No. 7,669,663, and a continuation-in-part of application No. 12/391,358, filed on Feb. 24, 2009.

(51) Int. Cl.
*E21B 23/00* (2006.01)

(52) U.S. Cl. ..... 175/268; 166/378; 166/381; 175/267; 175/263

(58) Field of Classification Search ..... 166/378, 166/381, 237; 175/271, 268, 267, 263, 286
See application file for complete search history.

(56) References Cited

U.S. PATENT DOCUMENTS

| | | | | |
|---|---|---|---|---|
| 1,258,418 | A | | 3/1918 | Kemble |
| 1,712,948 | A | | 5/1929 | Burch |
| 1,921,135 | A | | 8/1933 | Santiago |
| 2,039,943 | A | * | 5/1936 | Wickersham et al. ..... 285/3 |
| 2,153,034 | A | | 4/1939 | Baker |
| 2,170,452 | A | | 8/1939 | Grant |
| 2,196,657 | A | | 4/1940 | Burt |
| 2,320,670 | A | | 6/1943 | Scaramucci |
| 2,427,052 | A | | 9/1947 | Grant |
| 2,615,519 | A | | 10/1952 | Carr |
| 2,708,100 | A | * | 5/1955 | Sutliff ..... 175/294 |
| 2,737,244 | A | | 3/1956 | Baker |
| 3,001,584 | A | | 9/1961 | Scott |
| 3,039,531 | A | | 6/1962 | Scott |
| 3,054,415 | A | | 9/1962 | Baker et al. |
| 3,126,065 | A | | 3/1964 | Chadderdon |
| 3,130,783 | A | | 4/1964 | Orr |
| 3,403,729 | A | | 10/1968 | Hickey |
| 3,703,104 | A | | 11/1972 | Tamplen |
| 3,758,731 | A | | 9/1973 | Vann et al. |
| 3,823,773 | A | | 7/1974 | Nutter |
| 3,986,554 | A | | 10/1976 | Nutter |
| 4,007,797 | A | | 2/1977 | Jeter |
| 4,033,408 | A | | 7/1977 | Fredd |
| 4,081,042 | A | | 3/1978 | Johnson |
| 4,132,243 | A | | 1/1979 | Kuus |
| 4,266,605 | A | | 5/1981 | LaBorde |
| 4,491,187 | A | | 1/1985 | Russell |
| 4,520,870 | A | | 6/1985 | Pringle |
| 4,574,894 | A | | 3/1986 | Jadwin |
| 4,596,293 | A | | 6/1986 | Wallussek et al. |
| 4,655,289 | A | | 4/1987 | Schoeffler |
| 4,714,116 | A | * | 12/1987 | Brunner ..... 166/321 |

(Continued)

*Primary Examiner* — Kenneth L Thompson
*Assistant Examiner* — Elizabeth Gitlin
(74) *Attorney, Agent, or Firm* — Brinks Hofer Gilson & Lione

(57) ABSTRACT

A tool comprising a fluid path defined by a bore formed within a tubular body includes a guided sleeve and a reciprocating sleeve disposed within the bore. A gearwheel is located on an outer surface of the guided sleeve and at least one pawl located on an inner surface of the reciprocating sleeve. When the reciprocating sleeve translates axially, it rotates in a first direction. As the reciprocating sleeve rotates, the at least one pawl pushes the gearwheel and causes the guided sleeve to rotate in the first direction into a new position.

11 Claims, 13 Drawing Sheets

U.S. PATENT DOCUMENTS 4,782,894 A 11/1988 LaFleur
4,869,100 A 9/1989 Birdwell
4,889,199 A 12/1989 Lee
4,893,678 A 1/1990 Stokley et al.
4,895,214 A 1/1990 Schoeffler
4,928,520 A 5/1990 Barrington
5,146,984 A * 9/1992 Pleasants ..... 166/238
5,189,645 A 2/1993 Innes
5,230,390 A 7/1993 Zastresek
5,316,094 A 5/1994 Pringle
5,392,862 A 2/1995 Swearingen
5,499,687 A 3/1996 Lee
5,553,678 A 9/1996 Barr
5,584,342 A * 12/1996 Swinford ..... 166/301
5,609,178 A 3/1997 Hennig
5,673,763 A 10/1997 Thorp
5,685,379 A 11/1997 Barr
5,695,015 A 12/1997 Barr
5,706,905 A 1/1998 Barr
5,730,222 A 3/1998 Rike
5,803,185 A 9/1998 Barr
5,833,002 A 11/1998 Holcombe
5,856,790 A 1/1999 Baugh et al.
6,089,332 A 7/2000 Barr
6,142,250 A 11/2000 Griffin
6,186,249 B1 * 2/2001 Bjornstad ..... 175/320
6,382,330 B2 5/2002 Bischel et al.
6,390,200 B1 5/2002 Allamon
6,419,014 B1 7/2002 Meek et al.
6,431,270 B1 8/2002 Angle
6,561,289 B2 5/2003 Portman et al.
6,571,888 B2 6/2003 Comeau et al.
6,619,388 B2 9/2003 Dietz et al.
6,717,283 B2 4/2004 Skinner
6,732,817 B2 5/2004 Dewey
6,776,240 B2 8/2004 Kenison
6,854,953 B2 2/2005 Van Drentham-Susman
6,920,930 B2 7/2005 Allamon
7,036,611 B2 5/2006 Radford
7,048,078 B2 5/2006 Dewey
7,219,747 B2 5/2007 Gleitman et al.
7,261,184 B2 8/2007 Bass et al.
7,308,937 B2 12/2007 Radford
7,331,397 B1 2/2008 Wagley
7,637,323 B2 12/2009 Schasteen et al.
7,779,933 B2 * 8/2010 Sihler et al. ..... 175/61
2004/0256153 A1 12/2004 Helms et al.
2005/0145417 A1 7/2005 Radford
2006/0034154 A1 2/2006 Perry et al.
2006/0243455 A1 11/2006 Telfer et al.
2007/0017679 A1 1/2007 Wolf et al.
2007/0056724 A1 3/2007 Spring et al.
2007/0062706 A1 3/2007 Leising
2007/0107944 A1 5/2007 Lee
2007/0242565 A1 10/2007 Hall et al.
2007/0251696 A1 11/2007 Parks
2007/0295514 A1 * 12/2007 Rohde et al. ..... 166/386
2008/0041597 A1 * 2/2008 Fisher et al. ..... 166/381
2008/0105464 A1 5/2008 Radford
2008/0217024 A1 9/2008 Moore
2008/0296015 A1 12/2008 Hall et al.
2009/0044951 A1 2/2009 Milkovisch et al.
2009/0056497 A1 * 3/2009 Swinford ..... 74/640
2009/0126936 A1 5/2009 Begley et al.
2009/0166086 A1 7/2009 Sugiura
2010/0132954 A1 6/2010 Telfer
2011/0278017 A1 11/2011 Themig et al.

* cited by examiner

RATCHET MECHANISM IN A FLUID ACTUATED DEVICE

CROSS REFERENCE TO RELATED APPLICATIONS

This application is a continuation-in-part of U.S. patent application Ser. No. 12/511,209 filed on Jul. 29, 2009, which is a continuation of U.S. patent application Ser. No. 12/511,185 filed on Jul. 29, 2009, which is a continuation-in-part of U.S. patent application Ser. No. 12/424,853 filed on April 16, 2009 and which issued as U.S. Pat. No. 7,669,663 on Mar. 2, 2010, and U.S. patent application Ser. No. 12/391,358 filed on Feb. 24, 2009, which are both herein incorporated by reference for all that they disclose.

BACKGROUND

Actuation mechanisms are involved in downhole drilling and in general are used to activate or deactivate a component of the downhole tool such as a reamer. Actuation mechanisms are typically implemented by dropping an object, usually a ball, down a bore of a downhole tool string. The ball gets caught by an actuation system causing a rise in pressure. As the pressure rises, the ball is pushed through the actuation mechanism which results in the activation or deactivation of the component. The prior art discloses mechanical actuation of downhole tools.

One such actuation mechanism is disclosed in U.S. Pat. No. 4,893,678 to Stokley, which is herein incorporated by reference for all that it contains. Stokley discloses a downhole tool suitable for multiple setting and unsetting operations in a well bore during a single trip. The downhole tool is suspended in the wellbore from a tubing string, and is activated by dropping a metal ball which plugs the passageway through the tubing string, such that the tubing pressure may thereafter be increased to activate the downhole tool. A sleeve is axially moveable within a control sub from a ball stop position to a ball release position, and has a cylindrical-shaped interior surface with an inside diameter only slightly greater than the ball. Collet fingers carried on the sleeve are radially movable from an inward position to an outward position to stop or release the ball as a function of the axial position of the sleeve. Fluid flow through the tubing string is thus effectively blocked when the sleeve is in the ball stop position because of the close tolerance between thse sleeve and the ball, while the ball is freely released from the sleeve and through the downhole tool when the sleeve is moved to the ball release position.

Another such actuation mechanism is disclosed in U.S. Pat. No. 5,230,390 to Zastresek, which is herein incorporated by reference for all that it contains. In Zastresek, a closure mechanism for preventing fluid access to an inner tube of a core barrel assembly is disclosed in which the closure mechanism is configured to move from an open, or unoccluded, condition to an occluded condition in response to increased fluid flow rates and pressure differentials occurring at the closure mechanism. The closure mechanism is also configured to maintain occlusion of the inner tube under substantially all types of drilling conditions, and particularly those where conventional closure mechanisms may fail, such as in horizontal drilling. The closure mechanism generally includes a conduit structure associated with the inner tube, and having a seat, an occlusion structure, such as a ball, and releasing structure which maintains the occlusion structure in spaced relationship to the seat until increasing pressure differentials result in release of the occlusion structure to register the seat.

BRIEF SUMMARY

In one aspect of the present invention, a tool has a fluid path defined by a bore formed within a tubular body. A guided sleeve and a reciprocating sleeve are both disposed within the bore. A gearwheel is located on an outer surface of the guided sleeve and at least one pawl located on an inner surface of the reciprocating sleeve. When the reciprocating sleeve translates axially, it rotates in a first direction. As the reciprocating rotates, the at least one pawl pushes the gearwheel and causes the guided sleeve to rotate in the first direction into a new position.

A biasing element may return the reciprocating sleeve to its original axial position. Upon the reciprocating sleeve's return to its original axial position, a male thread and female thread engage to return the reciprocating sleeve to its original rotational position. The gearwheel, which may comprise a plurality of alternating gear teeth and gear troughs, allows the guided sleeve to maintain its new position as the reciprocating sleeve returns to its original position because the at least one pawl may slide into an adjacent gear trough on the gearwheel.

An obstruction element may be dropped within the bore, and a seat mechanically connected to the reciprocating sleeve may block the obstruction element as it passes through the bore. A resulting fluid pressure build-up may cause the reciprocating sleeve to translate axially. In some embodiments, as the reciprocating sleeve translates, it rotates due to the male thread and the female thread and the seat may rotate in accordance with that rotation. The seat may be a collet which may comprise a plurality of collet fingers and a plurality of slits in between the collet fingers. As the obstruction element is restricted by the seat, fluid may pass through the plurality of slits.

Other embodiments maintain the rotational motion as the reciprocating sleeve translates axially. One such embodiment comprises a plurality of slits angled causing the reciprocating sleeve to rotate in a first direction due to the fluid passing through the plurality of slits. Another such embodiment comprises at least one pin received within at least one channel which causes the reciprocating sleeve to rotate in a first direction.

The present invention may be useful in a variety of systems including downhole tool string systems, hydraulic systems, pipeline systems, or transmission systems.

In another aspect of the present invention a tool comprises a fluid path defined by a bore formed within a tubular body, a reciprocating sleeve disposed within the bore, a fluid passage leading from the fluid path to a chamber which is initially closed, and an obstruction element disposed within the fluid path. When the obstruction element is caught within the bore, a pressure differential in the fluid path is created. The pressure differential causes fluid to flow through the fluid passage into the chamber causing the chamber to open. Once open the fluid pressure axially translates on the reciprocating sleeve.

The fluid passage may contain a tortuous path, which may comprise a series of notches formed on its surface. At least one channel may provide a fluid path between the fluid passage and the chamber. The fluid may move into the chamber when a pressure differential exists, a pressure sleeve facilitates the increase of the pressure differential. The tool may also comprise a plurality of slots that allow fluid circulation through at least part of the downhole tool.

DETAILED DESCRIPTION

Figure 1:
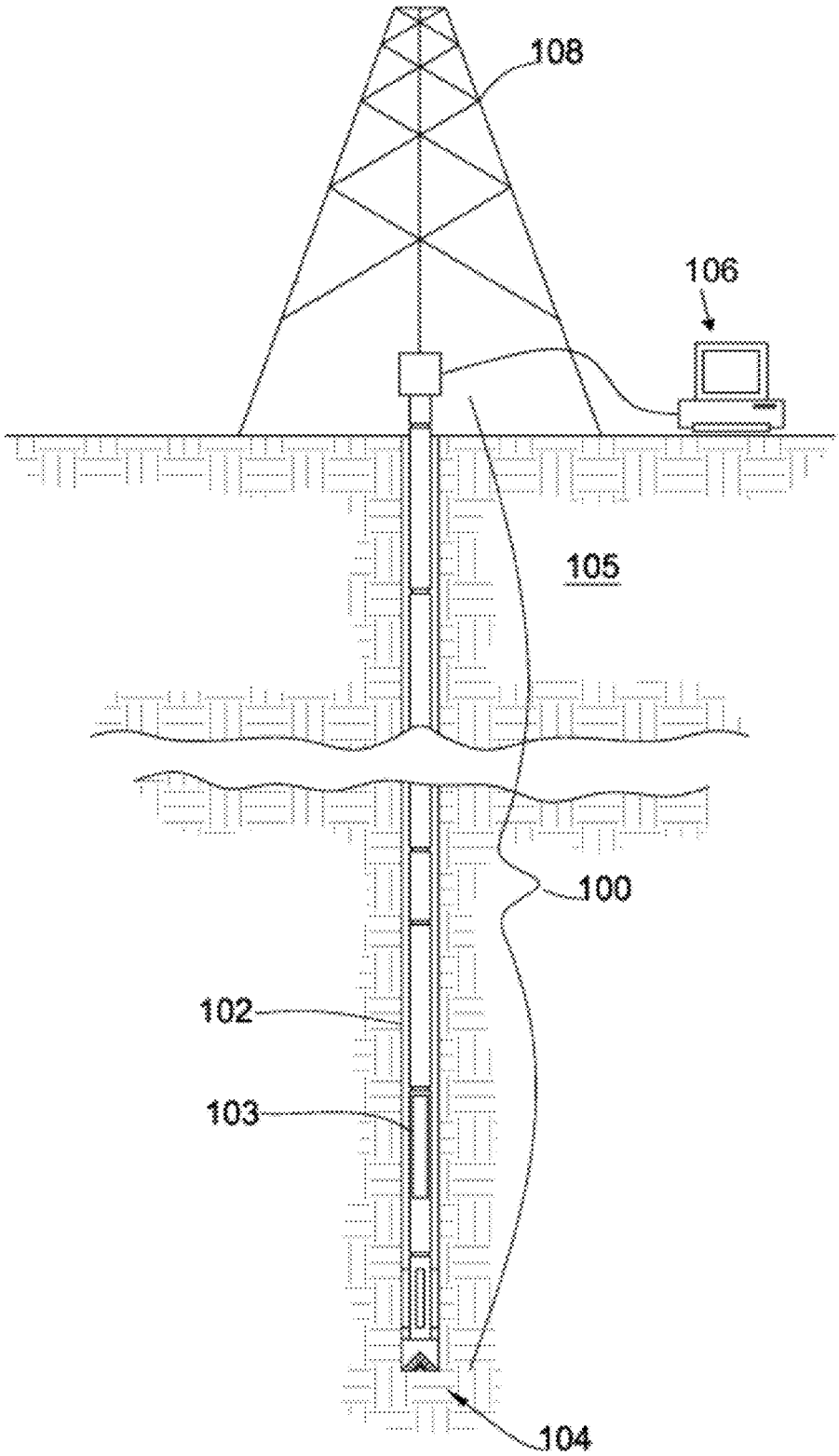
FIG. 1 is a cross-sectional view of an embodiment of a drill string.

FIG. 1 discloses an embodiment of a downhole tool string 100. The tool string 100 may be suspended by a derrick 108 within an earthen formation 105. The tool string 100 may comprise a drill bit 104 and one or more downhole components 103. In this embodiment, the one or more downhole components 103 may comprise a reamer used for enlarging a bore 102 in the earthen formation 105. The downhole tool string 100 may be in communication with surface equipment 106.

Figure 2:
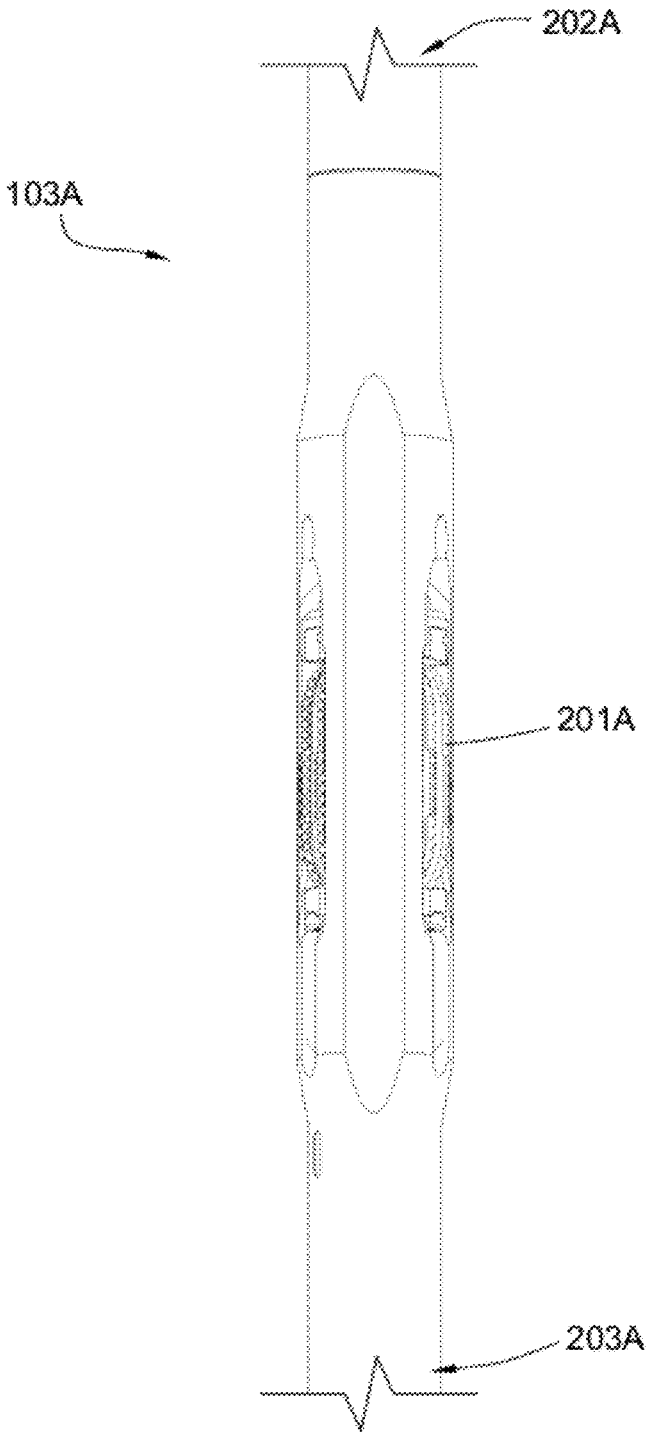
FIG. 2 is an orthogonal view of a section of an embodiment of a downhole tool.

FIG. 2 discloses an embodiment of a downhole tool 103A with a first end 202A and a second end 203A. The first end 202A may connect to a portion of drill string that extends to a surface of a borehole, and the second end 203A may connect to a bottom hole assembly, drill bit, or other drill string segment. Downhole tool 103A includes an expandable reamer 201A for bore hole enlargement.

Figure 3:
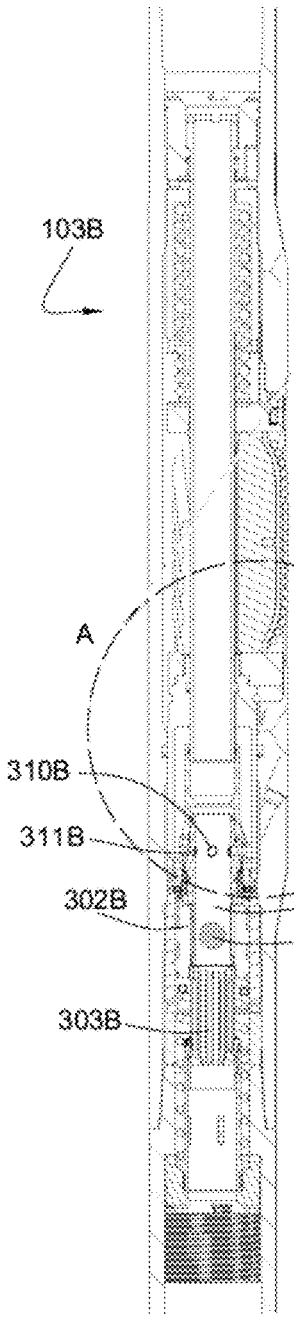
FIG. 3 is a cross-sectional view of an embodiment of a downhole tool.
Figure 3A:
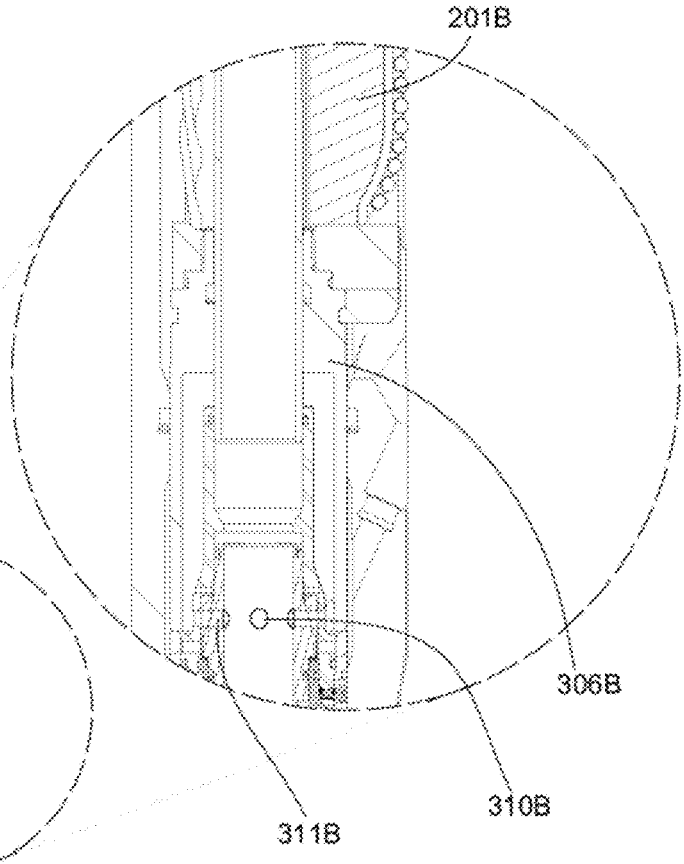
FIG. 3*a* is a close up, cross-sectional view of the embodiment of FIG. 3

FIG. 3 illustrates a cross-section of a downhole tool 103B and FIG. 3*b* illustrates a magnified view of a portion of an actuation mechanism of the downhole tool 103B indicated by circle A. A guided sleeve 301B and a reciprocating sleeve 302B are disposed concentrically within a bore of the downhole tool 103B. A seat 303B may be attached to the reciprocating sleeve 302B that may catch an obstruction element 304B within the bore. A resulting pressure build up in the bore may cause the guided sleeve 301B and the reciprocating sleeve 302B to interact with each other to open a fluid port 310B leading into channel 311B as shown in FIG. 3*a*.

FIG. 3*b*illustrates fluid, such as drilling mud, from the open fluid port 310B pushing against a piston 306B within channel 311B. The fluid pushes the piston 306B forward which causes a reamer 201B to extend radially.

Figure 4A:
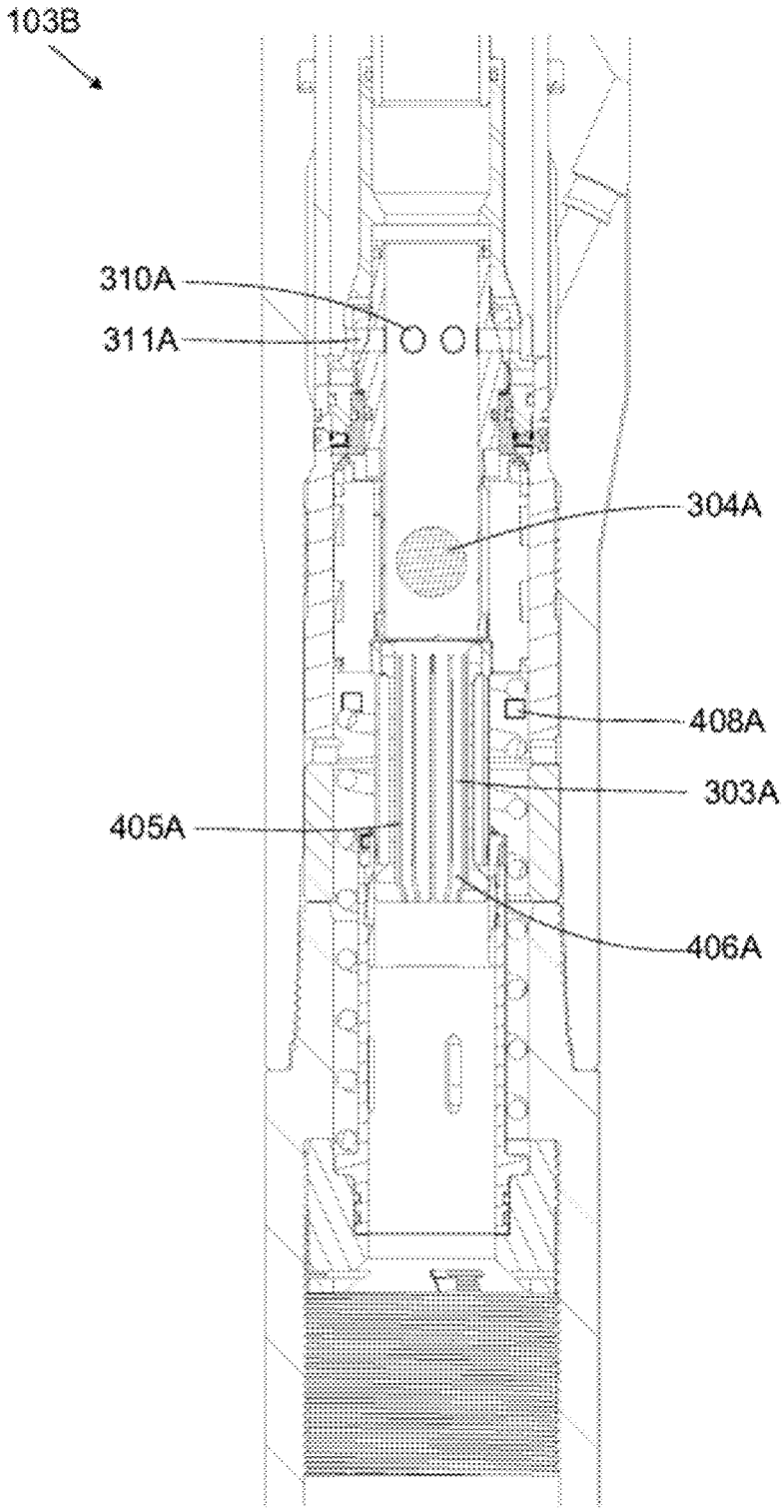
FIG. 4*a* is a cross-sectional view of an embodiment of a downhole tool.

FIG. 4*a* discloses the actuation system of FIG. 3 before the actuation system has been actuated. The seat 303B located in the bore may comprise a plurality of fingers 406B and a plurality of slits 405B. When the obstruction element 304B lodges in the seat 303B, a fluid pressure differential is generated and fluid passes through the plurality of slits 405B preventing a complete fluid blockage. Allowing a sufficient amount of fluid to pass by the obstruction element 304B may be important so that other downstream applications that utilize the fluid are not comprised. For example, drilling mud may play an important role at the drill bit by cooling the cutting inserts and clearing the cuttings out of the hole. At least one by-pass 408B is disposed within the downhole tool 103B allowing fluid to circulate past the seat 303B when the obstruction element 304B is loaded within it. The circulation of fluid helps the flow throughout the fluid path and aids in keeping the downhole tool 103B clean.

Figure 4B:
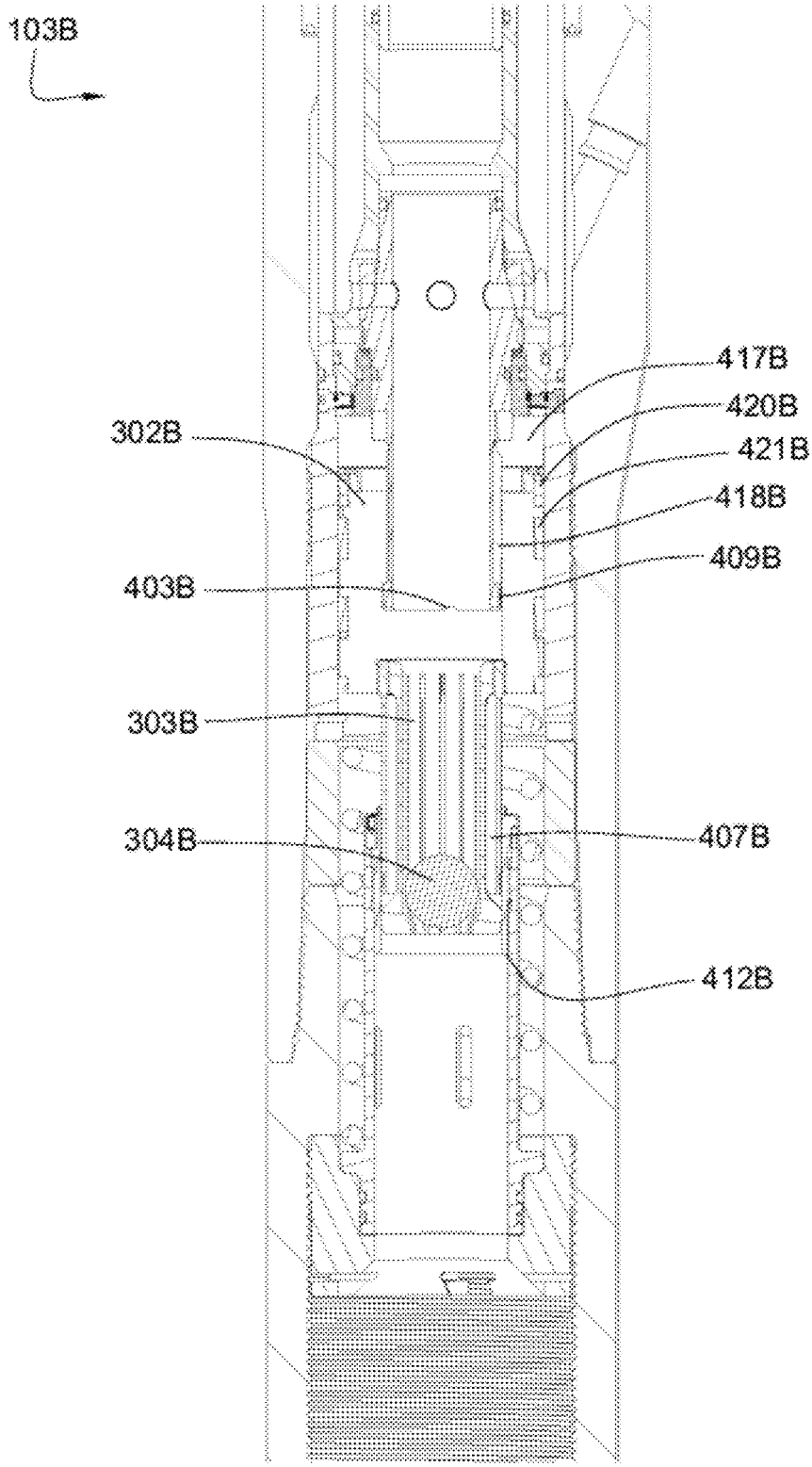
FIG. 4*b* is a cross-sectional view of another embodiment of a downhole tool.

FIG. 4*b* discloses the actuation system of FIG. 3 as it is being actuated. Due to the pressure differential, the seat 303B is pushed along the bore and pulls a reciprocating sleeve 302B with it. On the outer surface of the reciprocating sleeve 302B male thread 420B engages with a female thread 421B on the inner surface of the downhole tool 103B. When the reciprocating sleeve 302B translates downward, it rotates in a first direction. As the reciprocating sleeve 302B rotates, the seat 303B rotates also. After translating a distance, the seat 303B reaches an increase of diameter 412B that allows the seat 303B to expand enough to release the obstruction element 304B.

Figure 4C:
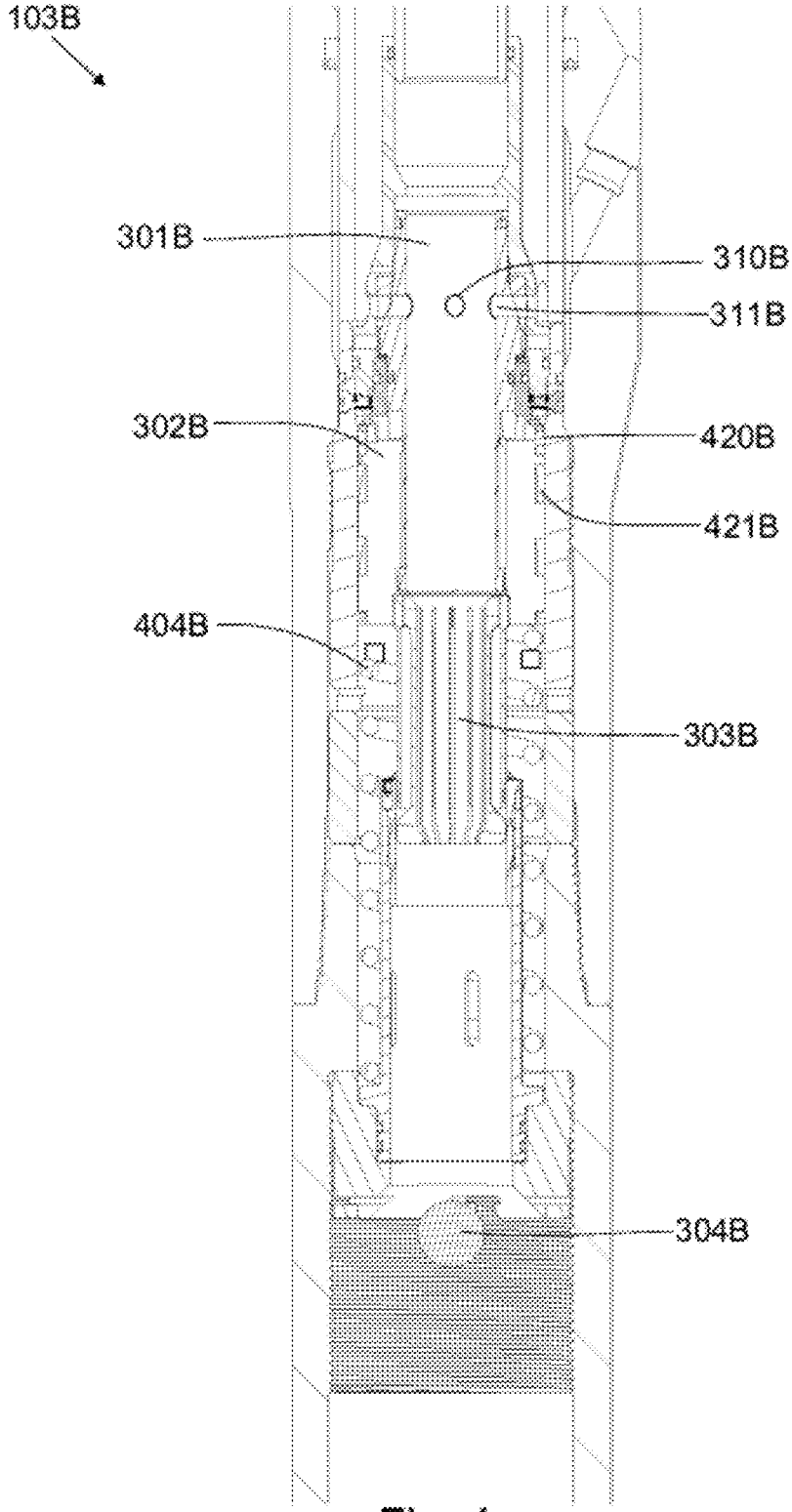
FIG. 4*c* is a cross-sectional view of another embodiment of a downhole tool.

FIG. 4*c* discloses the actuation system of FIG. 3 immediately after the obstruction element 304B has passed through the seat 303B. A biasing element 404B pushes the seat 303B upward to its original axial positions. As the seat 303B moves upward, the male thread 420B and the female thread 421B cause the reciprocating sleeve 302B to rotate opposite of the first direction. The reciprocating sleeve 302B finds itself in its original rotational position.

The actuation system is actuated when the ports 310B are aligned with the channels 311B. This allows the fluid to flow through the channel 311B and activate other parts of the downhole tool 103B. The ports 310B are disposed upon the guided sleeve 301B. The reciprocating sleeve 302B and the guided sleeve 301B are related so that when the reciprocating sleeve 302B rotates in a first direction, the guided sleeve 301B rotates in the same direction. As the guided sleeve 301B rotates, the ports 310B become aligned and misaligned with the channels 311B. FIG. 4*a* shows the ports 310B not in alignment with the channels 311B because the actuation system has not yet been actuated.

Referring back to FIG. 4*b*, a fluid passage 418B is disposed within the downhole tool 103B and leads from the fluid path to a chamber 417B. The chamber 417B is initially closed, but opens as the reciprocating sleeve 302B translates downward. Disposed between the fluid passage 418B and the chamber 417B is at least one channel 403B which allows fluid to pass into the chamber 417B. As the chamber 417B opens the fluid applies pressure on the reciprocating sleeve 302B translating it axially. A pressure sleeve 407B, disposed around the seat 303B, prevents too much pressure from escaping through the slits 405B.

The fluid passage 418B may contain a tortuous path 409B that may comprise a series of notches. As the reciprocating sleeve 302B is returning to its original axial position, the tortuous path 409B causes the fluid that is being pushed out of the chamber 417 to slow down, which hydraulically dampen the reciprocating sleeve 302B returns.

Figure 5:
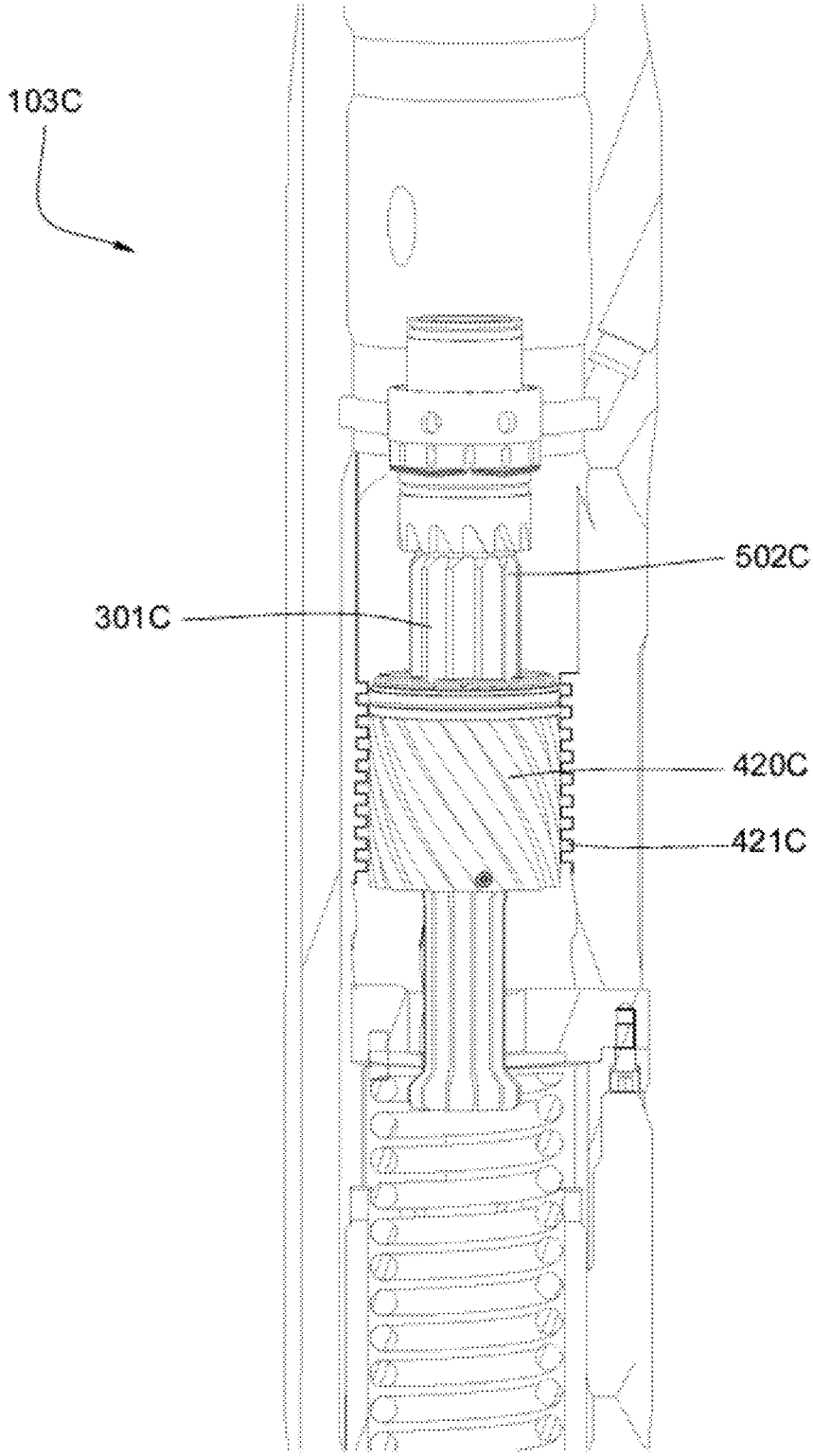
FIG. 5 is a partial cross-sectional view of an embodiment of a downhole tool.

FIG. 5 illustrates an embodiment of an actuation mechanism of a downhole tool 103C showing a male thread 420C and a female thread 421C. Also shown in this embodiment is a gearwheel 502C disposed on a guided sleeve 301C.

Figure 6A:
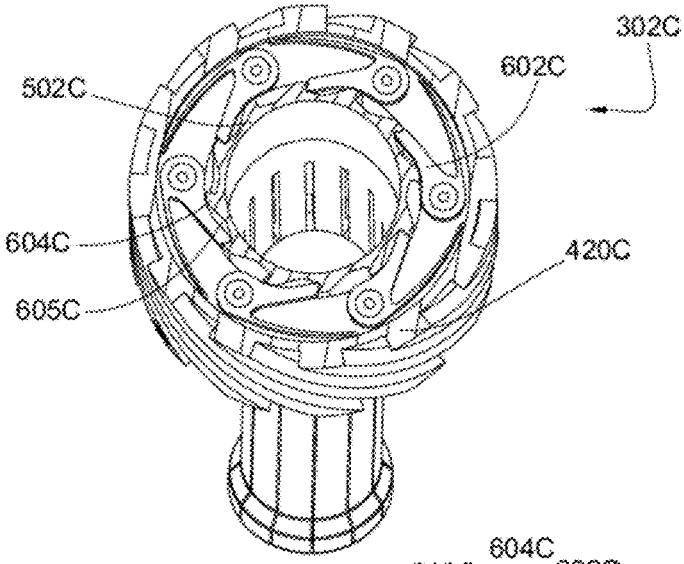
FIG. 6*a* is a perspective view of an embodiment of a reciprocating sleeve.

FIG. 6*a* illustrates a reciprocating sleeve 302C having a male thread 420C and at least one pawl 602C. The pawl 602C is in relation with the gearwheel 502C which comprises a plurality of gear teeth 604C and gear troughs 605C.

Figure 6B:
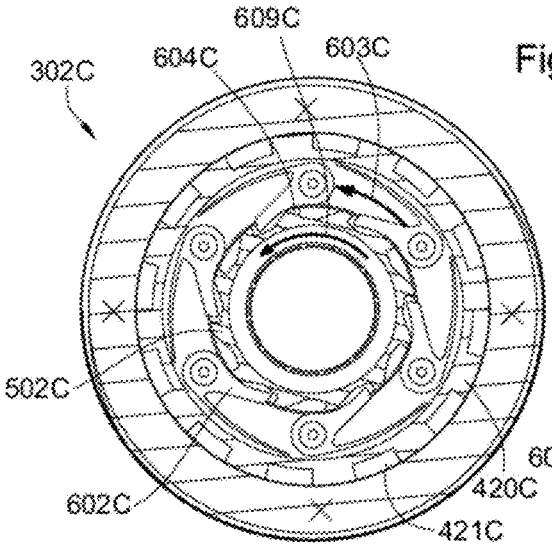
FIG. 6*b* is a cross-sectional view of an embodiment of a reciprocating sleeve

FIG. 6*b* illustrates the reciprocating sleeve 302C translating axially into the page. As the reciprocating sleeve 302C translates axially it rotates in a first direction 603C due to the interaction of the male thread 420C and the female thread 421C. The pawl 602C engages the gearwheel 502C by pushing a gear tooth 604C in the first direction 603C. The gearwheel 502C thus rotates in direction 609C into a new position.

Figure 6C:
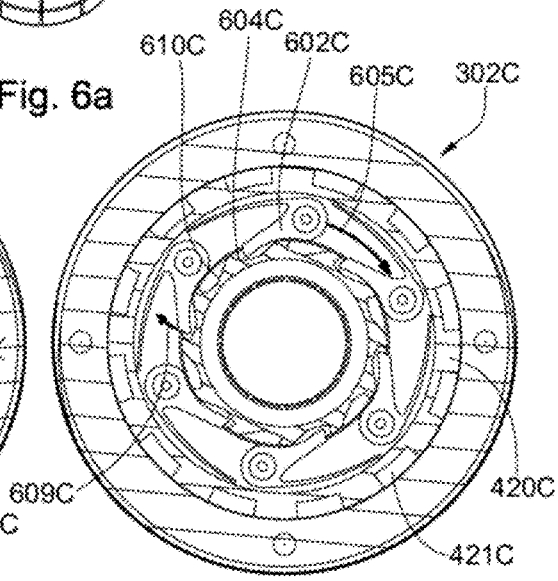
FIG. 6*c* is a cross-sectional view of another embodiment of a reciprocating sleeve.

FIG. 6*c* illustrates the reciprocating sleeve 302C translating axially out of the page and back to its original axial position. The male thread 420C and female thread 421C rotate the reciprocating sleeve 302C opposite of the first direction 603 and back to its original rotational position. The pawl 602C rotates in direction 605C where it comes into contact with a slanted slope 610C of a gear tooth 604C. The slanted slope 610C makes the pawl 602C move radially in direction 609C so returning the reciprocating sleeve 302C to its original rotational position.

Figure 7:
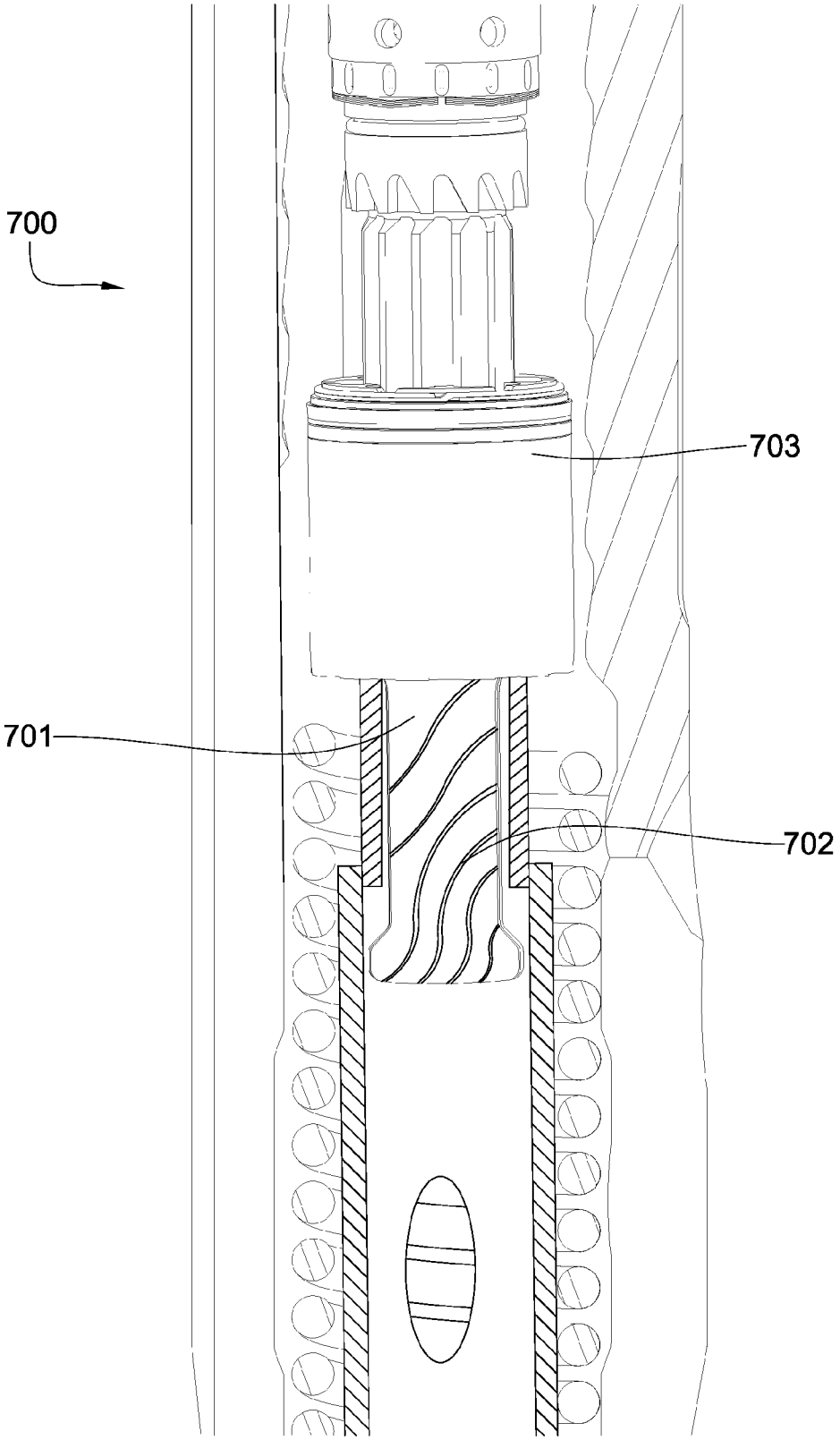
FIG. 7 is a cross-sectional view an embodiment of a downhole tool.

FIG. 7 discloses a seat 701 in a downhole tool 700 with a plurality of angled slits 702. As the seat 701 translates downward, the fluid passes through the plurality of angled slits 702. An angle of the plurality of angled slits 702 causes the seat 701 to rotate thereby rotating the reciprocating sleeve 703.

Figure 8:
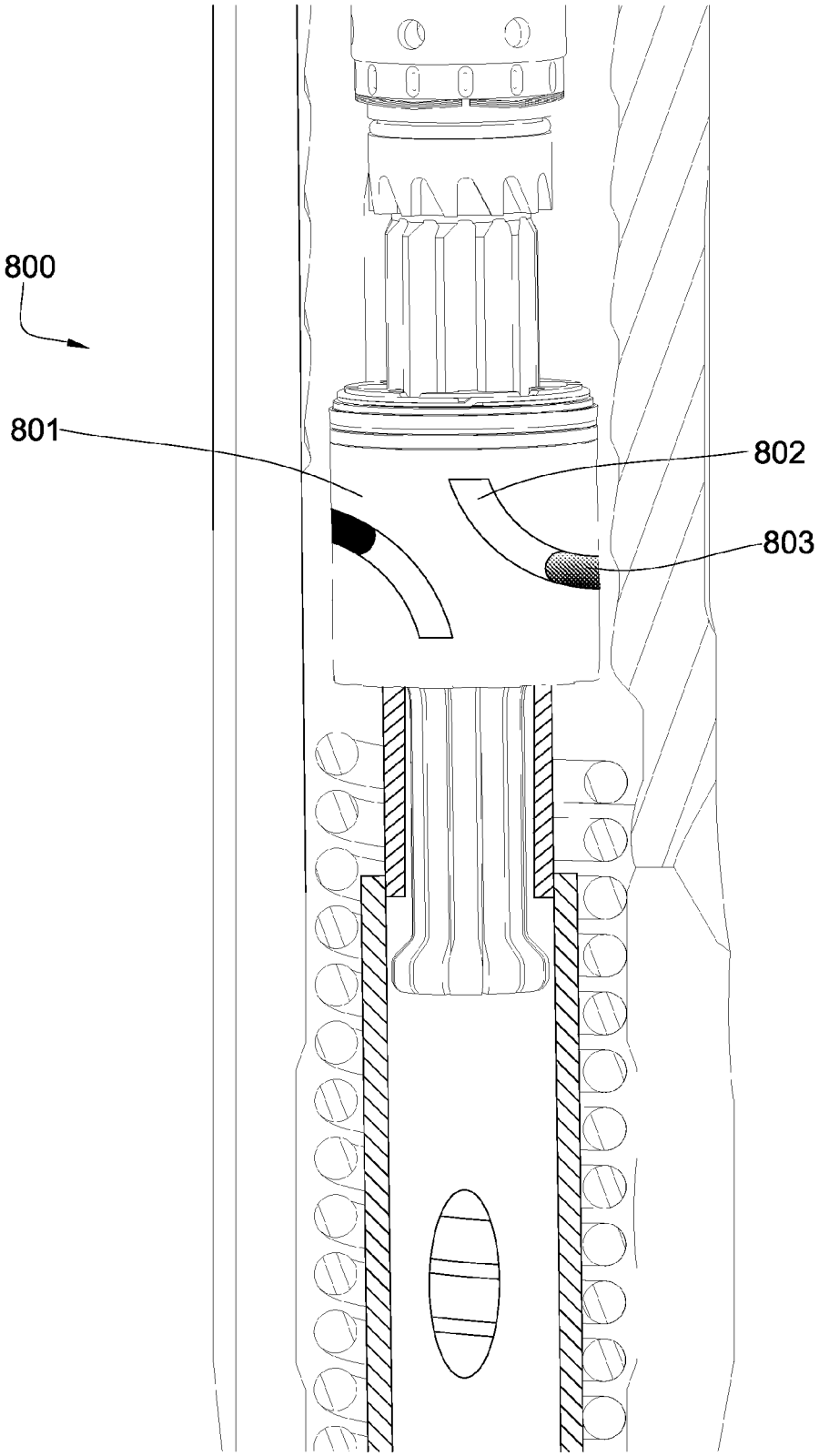
FIG. 8 is a cross-sectional view of an embodiment of a downhole tool.

FIG. 8 discloses a downhole tool 800 comprising a reciprocating sleeve 801 containing at least one pin 803 and at least one angled groove 802. As the reciprocating sleeve 801 translates downward, it also rotates due to the interaction between pin 803 and groove 802.

Figure 9:
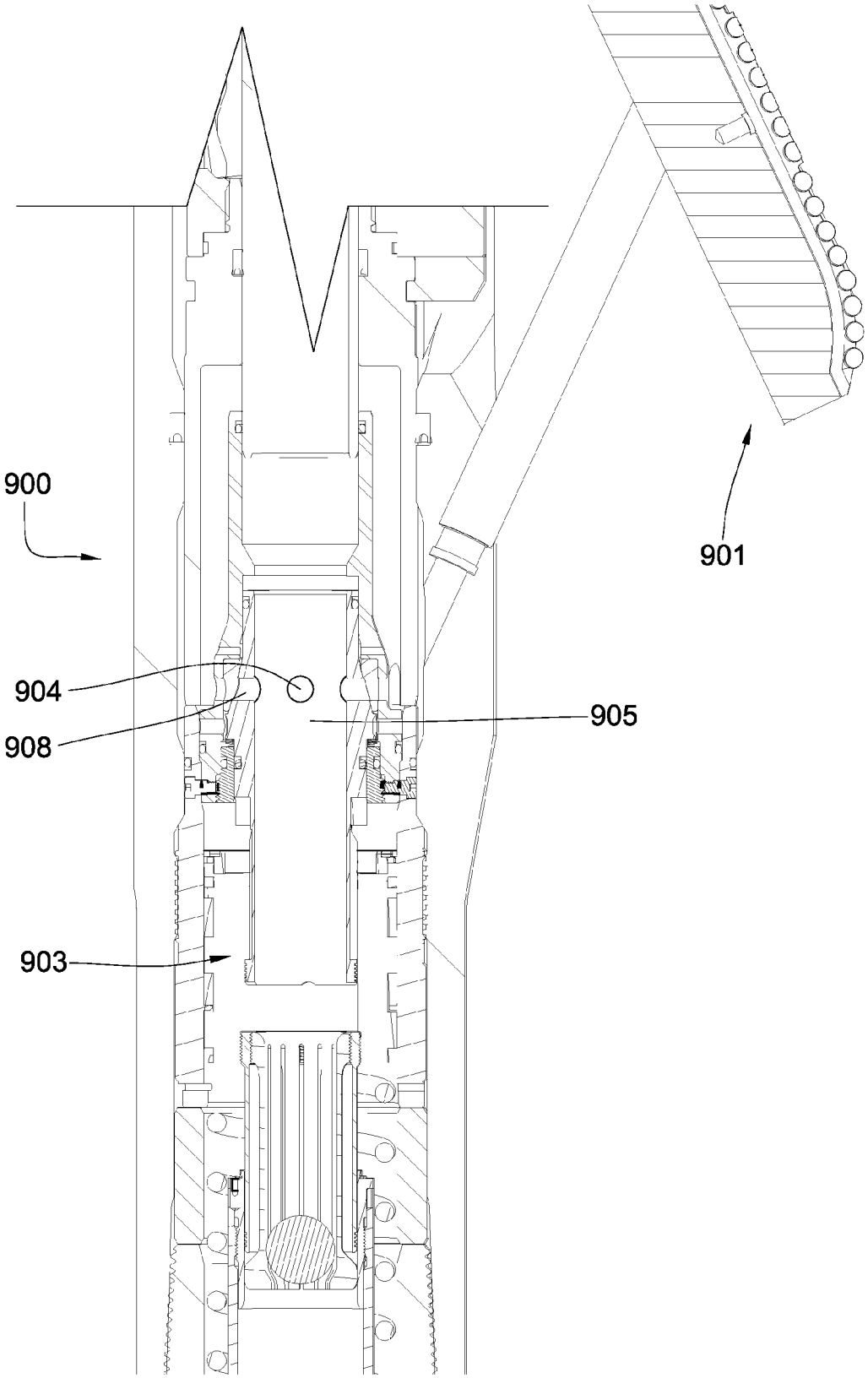
FIG. 9 is a cross-sectional view of an embodiment of a downhole tool.

FIG. 9 discloses a downhole tool 900 comprising a winged reamer 901. As the reciprocating sleeve 903 translates and rotates, the guided sleeve 905 also rotates aligning the ports 904 and channels 908. Fluid flows through the channels 908 and extends the winged reamer 901.

Figure 10:
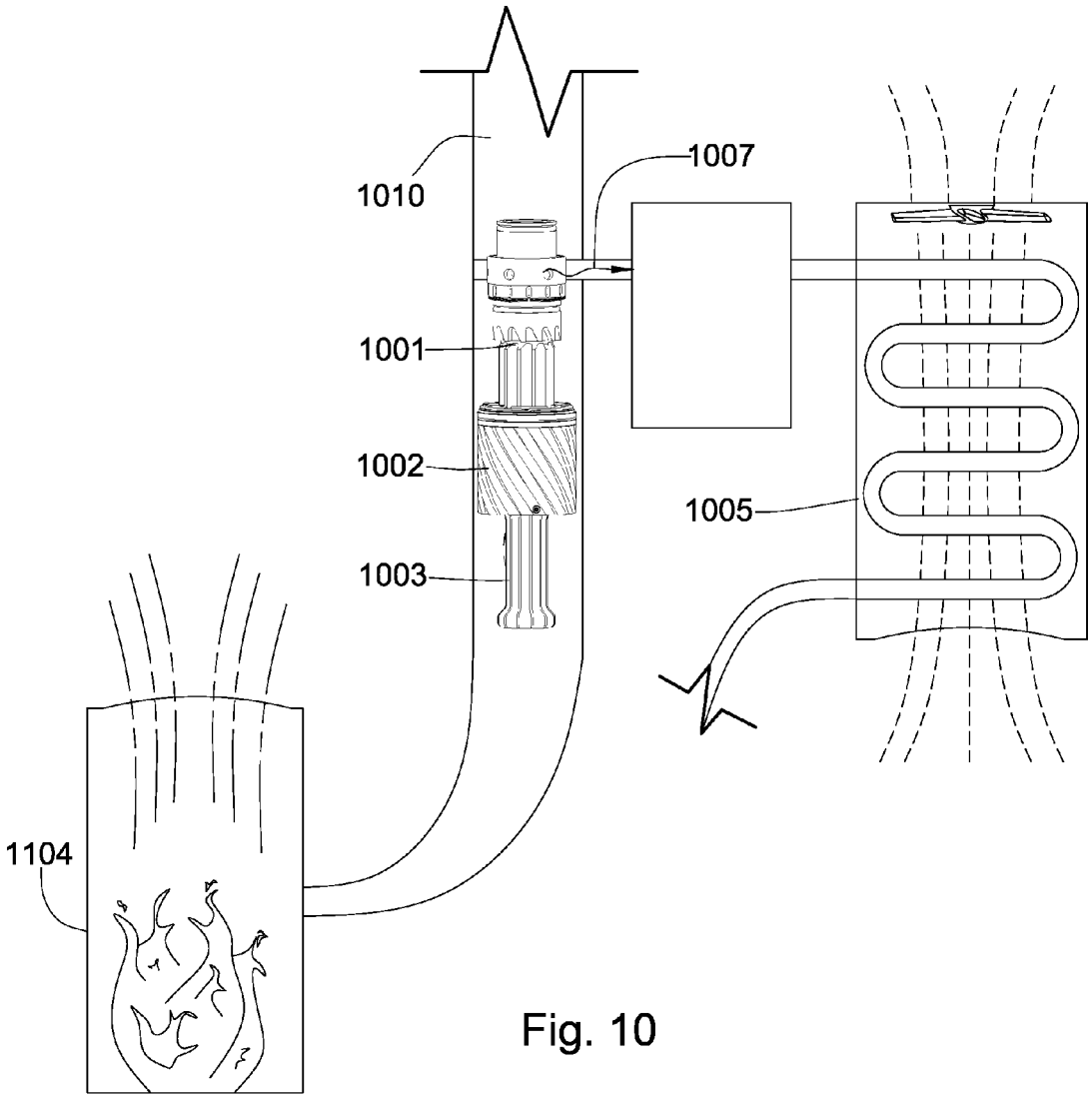
FIG. 10 is a system diagram of an embodiment of a hydraulic system.

FIG. 10 discloses an embodiment of an assembly with a guided sleeve 1001, a reciprocating sleeve 1002, and a seat 1003 disposed within a pipe 1010. When the actuation system is not actuated, a fluid flows into a furnace 1004 for heating. When the assembly is actuated, as described above, the fluid is redirected in another direction, represented by arrow 1007, to a cooling unit 1005. The present invention may be used in other piping systems including, heating systems, cooling systems, pipeline systems, transmission systems, clutch systems, mechanical systems, piston systems, ram systems, press systems, jet engine systems, propeller systems, fuel injection system, and combinations thereof.

Figure 11:
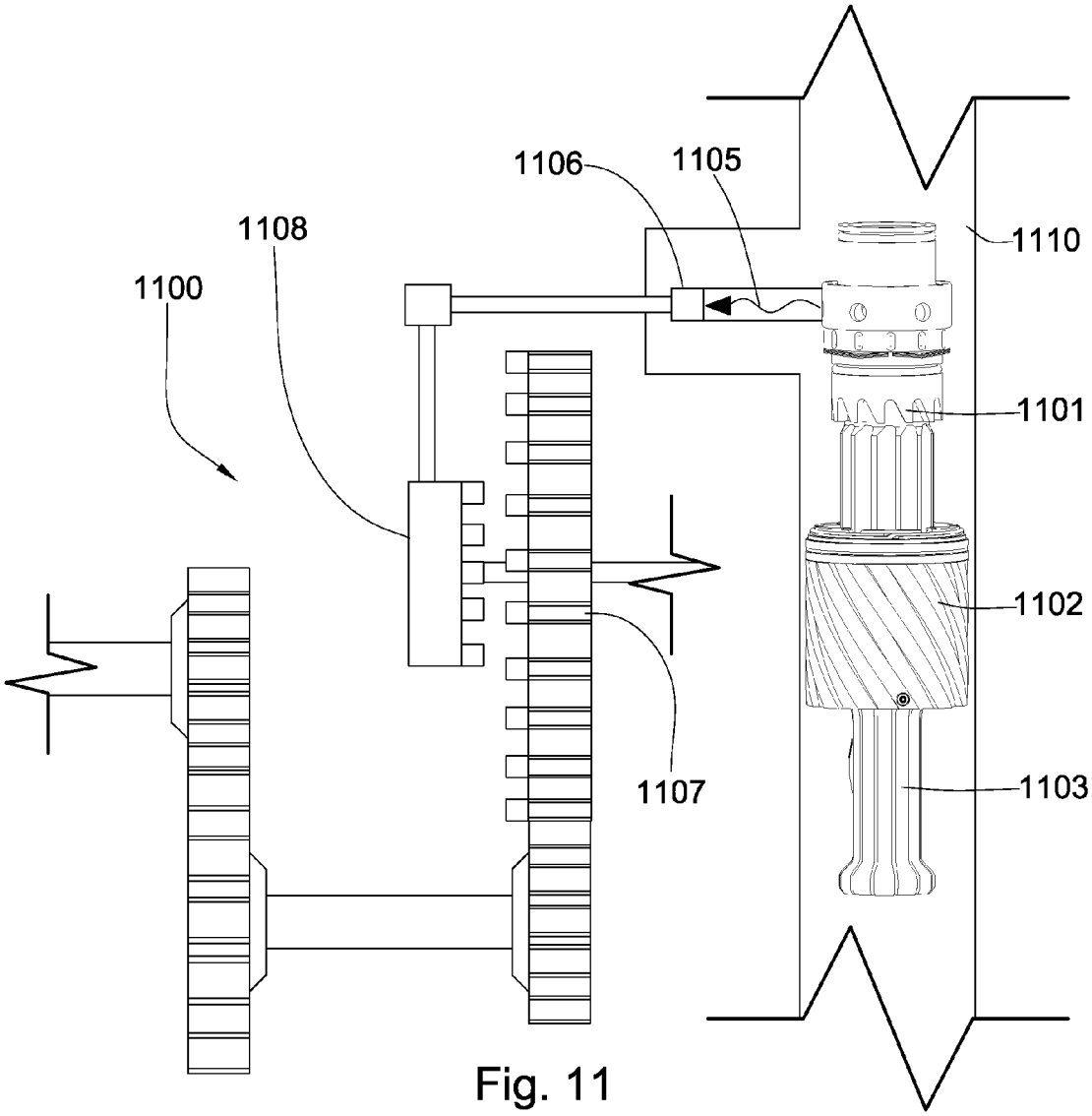
FIG. 11 is a diagram of an embodiment of a transmission system.

FIG. 11 discloses the application of the present invention in a transmission system 1100. The guided sleeve 1101, reciprocating sleeve 1102, and seat 1103 are disposed within a fluid path 1110. When actuated, the fluid flows in a direction, represented by arrow 1105, and applies pressure on piston 1106. The piston 1106 moves the collar 1108 to engage with the sprocket 1107. To disengage with the sprocket, the system may be actuated again.

Whereas the present invention has been described in particular relation to the drawings attached hereto, it should be understood that other and further modifications apart from those shown or suggested herein, may be made within the scope and spirit of the present invention.

What is claimed is:

1. A tool comprising:

a tubular body having a bore formed therein and an axis;

a guided sleeve disposed within the bore, the guided sleeve adapted to rotate about the axis and having an outer surface;

a reciprocating sleeve disposed within the bore, the reciprocating sleeve adapted to translate axially from a first position to a second position and constrained to rotate in a first direction when translated from the first position to the second position, and having an inner surface;

a seat connected to the reciprocating sleeve, the seat configured to restrict an obstruction element passing through the tool, wherein a restriction of the obstruction element causes a pressure differential across the seat causing the seat to translate axially;

a gearwheel located on the outer surface of the guided sleeve, the gearwheel comprising a plurality of alternating gear teeth and gear troughs and the gear teeth are configured to move the pawl teeth radially; and at least one pawl located on the inner surface of the reciprocating sleeve, the at least one pawl adapted to push the gearwheel in response to the reciprocating sleeve rotating in the first direction causing the gearwheel to rotate the guided sleeve to a new position and the at least one pawl adapted to move radially in response to the reciprocating sleeve rotating opposite the first direction.

2. The tool of claim 1, wherein the reciprocating sleeve is adapted to return to the first position.

3. The tool of claim 2, wherein the reciprocating sleeve is biased to return to the first position by a biasing element.

4. The tool of claim 1, wherein a rotation of the reciprocating sleeve causes a corresponding rotation of the seat.

5. The tool of claim 1, wherein the seat comprises a collet having a plurality of collet fingers and a plurality of slits between the collet fingers.

6. The tool of claim 5, wherein the plurality of slits are configured to pass a fluid in response to the seat restricting the obstruction element.

7. The tool of claim 6, wherein the plurality of slits are angled causing the reciprocating sleeve to rotate in a first direction in response to fluid passing through the plurality of slits.

8. The tool of claim 1, further comprising at least one pin attached to the tubular body and at least one channel disposed on the reciprocating sleeve, the at least one pin and the at least one channel are configured to cause the reciprocating sleeve to rotate in the first direction as the reciprocating sleeve is translated axially.

9. The tool of claim 1, wherein the tool is part of a downhole tool string.

10. The tool of claim 1, wherein the tool is part of a hydraulic system.

11. The tool of claim 1, wherein the tool is part of a transmission system.

* * * * *